US009010282B2

(12) United States Patent
Yamaguchi et al.

(10) Patent No.: US 9,010,282 B2
(45) Date of Patent: Apr. 21, 2015

(54) PISTON COOLING JET

(71) Applicants: Yoshitaka Yamaguchi, Kariya (JP); Masahiro Kawahara, Toyota (JP); Motoichi Murakami, Susono (JP); Akihiro Honda, Gotemba (JP)

(72) Inventors: Yoshitaka Yamaguchi, Kariya (JP); Masahiro Kawahara, Toyota (JP); Motoichi Murakami, Susono (JP); Akihiro Honda, Gotemba (JP)

(73) Assignees: Taiho Kogyo Co., Ltd., Toyota (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 14/027,784

(22) Filed: Sep. 16, 2013

(65) Prior Publication Data

US 2014/0091161 A1 Apr. 3, 2014

(30) Foreign Application Priority Data

Sep. 29, 2012 (JP) ..... 2012-218928

(51) Int. Cl.
*F01P 3/08* (2006.01)
*F01M 1/08* (2006.01)

(52) U.S. Cl.
CPC ... *F01P 3/08* (2013.01); *F01M 1/08* (2013.01)

(58) Field of Classification Search
CPC ..... F01M 1/08; F01P 3/06; F01P 3/08; F02F 3/16; F02F 3/20
USPC ..... 123/193.6, 41.31, 41.35, 41.44, 41.45, 123/196 R
See application file for complete search history.

(56) References Cited

U.S. PATENT DOCUMENTS

| | | | | | |
|---|---|---|---|---|---|
| 2,800,119 | A * | 7/1957 | Schmidl | ..... | 123/41.35 |
| 3,709,109 | A * | 1/1973 | Howe | ..... | 92/186 |
| 4,995,346 | A * | 2/1991 | Hudson, Jr. | ..... | 123/41.35 |
| 5,819,692 | A * | 10/1998 | Schafer | ..... | 123/41.35 |
| 5,881,684 | A * | 3/1999 | Bontaz | ..... | 123/41.35 |
| 6,789,650 | B2 * | 9/2004 | Yokotani et al. | ..... | 184/24 |

(Continued)

FOREIGN PATENT DOCUMENTS

| | | |
|---|---|---|
| EP | 0 346 264 | 12/1989 |
| EP | 1 391 229 A1 | 2/2004 |

(Continued)

OTHER PUBLICATIONS

Feb. 5, 2014 Extended European Search Report issued in European Patent Application No. 13186233.6.

(Continued)

*Primary Examiner* — Noah Kamen
*Assistant Examiner* — Grant Moubry
(74) *Attorney, Agent, or Firm* — Oliff PLC

(57) ABSTRACT

A piston cooling jet includes a housing, a nozzle, a valve, a pressure chamber, a pressure adjusting passage, and a filter. The nozzle is provided to project outward from the housing, and capable of spraying oil toward a piston. The valve is capable of moving reciprocally inside the housing, and configured to receive a load due to a hydraulic pressure in an engine-side oil passage applied from a front side of the valve. The valve includes a valve-side oil passage that communicates with the engine-side oil passage. The pressure chamber communicates with the valve-side oil passage. The pressure adjusting passage is disposed between the pressure chamber and a space outside the housing. The filter is disposed in the valve, and configured to remove foreign matter that cannot pass through the pressure adjusting passage from oil passing through the valve-side oil passage.

5 Claims, 7 Drawing Sheets

(56) References Cited

U.S. PATENT DOCUMENTS

| | | | | |
|---|---|---|---|---|
| 6,905,317 | B2 * | 6/2005 | Hirabayashi et al. | 417/440 |
| 2004/0031736 | A1 * | 2/2004 | Evans | 210/168 |
| 2004/0031737 | A1 * | 2/2004 | Evans et al. | 210/168 |

FOREIGN PATENT DOCUMENTS

| | | |
|---|---|---|
| JP | U-54-164328 | 11/1979 |
| JP | U-1982-073341 | 5/1982 |
| JP | 62-167819 | 10/1987 |
| JP | U-1987-193537 | 12/1987 |
| JP | A-2-75717 | 3/1990 |
| JP | A-9-68042 | 3/1997 |
| JP | A-11-22813 | 1/1999 |
| JP | A-2003-166408 | 6/2003 |
| JP | A-2009-221893 | 10/2009 |
| JP | A-2009-228789 | 10/2009 |
| JP | A-2011-012650 | 1/2011 |
| JP | A-2011-064155 | 3/2011 |
| JP | A-2013-217203 | 10/2013 |

OTHER PUBLICATIONS

Sep. 2, 2014 Office Action issued in Japanese Patent Application No. 2012-218928 (with English translation).

* cited by examiner

PISTON COOLING JET

INCORPORATION BY REFERENCE

The disclosure of Japanese Patent Application No. 2012-218928 filed on Sep. 29, 2012 including the specification, drawings and abstract is incorporated herein by reference in its entirety.

BACKGROUND OF THE INVENTION

1. Field of the Invention

The present invention relates to a piston cooling jet that cools a piston of an engine by spraying oil toward the back surface of the piston.

2. Description of Related Art

A piston cooling jet is attached to a cylinder block of an engine. The piston cooling jet communicates with a main oil gallery of the cylinder block. The main oil gallery forms a part of an oil circulation circuit of the engine. The piston cooling jet is provided with a hydraulic valve mechanism.

When the hydraulic pressure of oil in the main oil gallery is equal to or more than a predetermined threshold, the hydraulic valve mechanism of the piston cooling jet is opened. This causes oil in the main oil gallery to be sprayed toward the back surface of the piston by the piston cooling jet. The spray of oil cools the piston.

During hot times when the piston is at a high temperature, the piston is preferably cooled by the piston cooling jet. During cold times when the piston is at a low temperature, however, it is necessary to warm the piston immediately. Therefore, cooling the piston using the piston cooling jet during cold times may hinder a rise in temperature of the piston. For such reason, oil is preferably not sprayed during cold times. However, the hydraulic valve mechanism of the piston cooling jet according to the related art is opened and closed in accordance with the hydraulic pressure in the main oil gallery, rather than the temperature of the engine. Therefore, the piston cooling jet may be actuated even during cold times.

In view of such issues, Japanese Patent Application Publication No. 2011-12650 (JP 2011-12650 A) discloses a piston cooling jet including a hydraulic-pressure valve mechanism section and an oil-temperature valve mechanism section. In the piston cooling jet according to JP 2011-12650 A, the hydraulic-pressure valve mechanism section switches the oil spraying state in accordance with the hydraulic pressure of oil. Meanwhile, the oil-temperature valve mechanism section switches the oil spraying state in accordance with the temperature of oil.

The hydraulic-pressure valve mechanism section uses one coil spring. Meanwhile, the oil-temperature valve mechanism section uses two coil springs. The two coil springs of the oil-temperature valve mechanism section are arranged in series along the direction of a passage of oil via a closure member. Of the two coil springs, the coil spring on the upper side (upstream side) is a shape memory spring made of a shape memory alloy. The urging force of the coil spring is varied in accordance with the temperature. Of the two coil springs, the coil spring on the lower side (downstream side) is a bias spring.

During cold times, the urging force of the bias spring is larger than that of the shape memory spring. Therefore, the passage of oil is closed. Thus, spraying of oil is stopped.

During hot times, on the other hand, the urging force of the shape memory spring is larger than that of the bias spring. Therefore, the passage of oil is opened. Thus, spraying of oil is allowed.

According to the piston cooling jet described in JP 2011-12650 A, however, a total of three coil springs are necessary. This complicates the structure of the piston cooling jet. This also increases the number of components.

According to the piston cooling jet described in JP 2011-12650 A, in addition, it is necessary that one of the three coil springs should be made of a shape memory alloy. This increases the manufacturing cost of the piston cooling jet.

In view of such issues, the present inventor has developed a novel piston cooling jet. It should be noted, however, that the piston cooling jet is not one of those according to the related art.

The piston cooling jet includes a housing, a valve, a leak gap, and a coil spring. The valve is housed in the housing so as to be reciprocally movable. The valve partitions the inside of the housing into a pressure receiving chamber on the upper side and a pressure chamber on the lower side to serve as a movable partition. The valve is provided with an orifice. The coil spring is housed in the pressure chamber. The coil spring urges the valve upward. The pressure receiving chamber communicates with a main oil gallery of the engine. The leak gap is disposed downstream of the pressure chamber. The leak gap communicates with the outside. Oil in the main oil gallery flows to the outside sequentially through the pressure receiving chamber, the orifice, the pressure chamber, and the leak gap.

The piston cooling jet includes the orifice provided upstream of the pressure chamber, and the leak gap provided downstream of the pressure chamber. This allows the internal pressure of the pressure chamber to be varied in accordance with the temperature and the hydraulic pressure of oil. Moreover, using the variations in the internal pressure allows the valve to be reciprocally moved between a valve open position and a valve closed position.

Thus, according to the novel piston cooling jet, oil spray control can be executed in accordance with the temperature and the hydraulic pressure of oil by the single coil spring. This simplifies the structure of the piston cooling jet. This also reduces the number of components. According to the novel piston cooling jet, in addition, it is not necessary that the coil spring should be made of a shape memory alloy. This reduces the manufacturing cost of the piston cooling jet.

In the case of the novel piston cooling jet, in order to control the internal pressure of the pressure chamber, it is necessary to secure an oil path (a path that leads from the main oil gallery to the outside by way of the pressure chamber). However, oil may contain, as mixed therein, foreign matter such as sludge, abrasion powder, dust, and machining powder produced during engine manufacture, for example. If the foreign matter clogs the oil path, oil does not flow smoothly. This makes it difficult to control the internal pressure of the pressure chamber.

In such a case, from the viewpoint of suppressing a rise in temperature of the piston, the piston cooling jet is preferably in a valve open state in which oil is sprayed toward the piston, rather than in a valve closed state in which oil is not sprayed toward the piston.

SUMMARY OF THE INVENTION

The piston cooling jet according to the present invention has been completed in view of the aforementioned issues. It is an object of the present invention to provide a piston cooling jet that can secure the valve open state even in the case where foreign matter clogs the oil path.

(1) In order to address the foregoing issues, an aspect of the present invention provides a piston cooling jet including: a housing; a nozzle provided to project outward from the housing and capable of spraying oil toward a piston; a valve capable of moving reciprocally inside the housing and configured to receive a load due to a hydraulic pressure in an engine-side oil passage applied from a front side of the valve, the valve including a valve-side oil passage that communicates with the engine-side oil passage; a pressure chamber defined inside the housing on a back side of the valve, the pressure chamber communicating with the valve-side oil passage; a pressure adjusting passage disposed between the pressure chamber and a space outside the housing; and a filter disposed in the valve and configured to remove foreign matter that cannot pass through the pressure adjusting passage from oil passing through the valve-side oil passage. In the piston cooling jet, the piston cooling jet is switchable between a valve closed state in which communication between the engine-side oil passage and the nozzle is prohibited, and a valve open state in which communication between the engine-side oil passage and the nozzle is allowed with the valve moved toward the back side to reduce a volume of the pressure chamber compared to that in the valve closed state.

The piston cooling jet according to the aspect of the present invention includes the filter. Therefore, the foreign matter mixed in the oil flowing through the oil path (a path that leads from the engine-side oil passage to the outside by way of the pressure chamber) can be removed by the filter in contrast to the novel piston cooling jet discussed above (that is not one of those according to the related art).

The filter is disposed in the valve. If the foreign matter clogs the filter, it is difficult for the oil to pass through the filter from the front side to the back side. That is, the resistance against passage through the filter is increased. This increases the load applied to the valve from the front side. Thus, the valve is moved toward the back side, and the piston cooling jet is brought into the valve open state. Thus, with the piston cooling jet according to the aspect of the present invention, the valve open state can be secured even in the case where the foreign matter clogs the filter. Therefore, the piston can be cooled even in the case where the foreign matter clogs the filter.

Oil is circulated in the engine through an oil pan, a pump, an oil filter, a cylinder block, the piston cooling jet, and again the oil pan by way of example. Immediately after the manufacture of the engine, machining powder produced during the engine manufacture may remain in the cylinder block. Therefore, if the engine is driven immediately after the engine manufacture, the machining powder may flow into the piston cooling jet before passing through the oil filter. Thus, the foreign matter easily clogs the oil path in the piston cooling jet.

In this respect, with the piston cooling jet according to the aspect of the present invention, the foreign matter mixed in the oil can be removed by the filter even in the case where the engine is driven immediately after the engine manufacture.

It is conceivable that if the valve were not provided with the filter, the foreign matter passing through the valve-side oil passage would clog the pressure adjusting passage. In this case, the internal pressure of the pressure chamber would be increased. This would increase the load applied to the valve from the back side. Thus, the piston cooling jet would not be easily switched to the valve open state.

In this respect, with the piston cooling jet according to the aspect of the present invention, the filter can remove the foreign matter that cannot pass through the pressure adjusting passage. Therefore, the foreign matter does not easily clog the pressure adjusting passage. Thus, the piston cooling jet is easily switched to the valve open state.

(2) In the configuration of (1) above, preferably, the valve-side oil passage includes an orifice; and the pressure adjusting passage is a leak gap that is smaller in opening width than the orifice and that is larger in total opening area than the orifice. The configuration allows the internal pressure of the pressure chamber to be adjusted easily in accordance with the temperature and the hydraulic pressure of oil.

(3) In the configuration of (2) above, preferably, the filter is disposed upstream of the orifice. According to the configuration, the foreign matter does not easily clog the orifice in addition to the leak gap.

According to the aspect of the present invention, it is possible to provide a piston cooling jet that can secure the valve open state even in the case where foreign matter clogs the oil path.

DETAILED DESCRIPTION OF THE EMBODIMENTS

A piston cooling jet according to an embodiment of the present invention will be described below.

First Embodiment

[Arrangement of Piston Cooling Jet]

Figure 1:
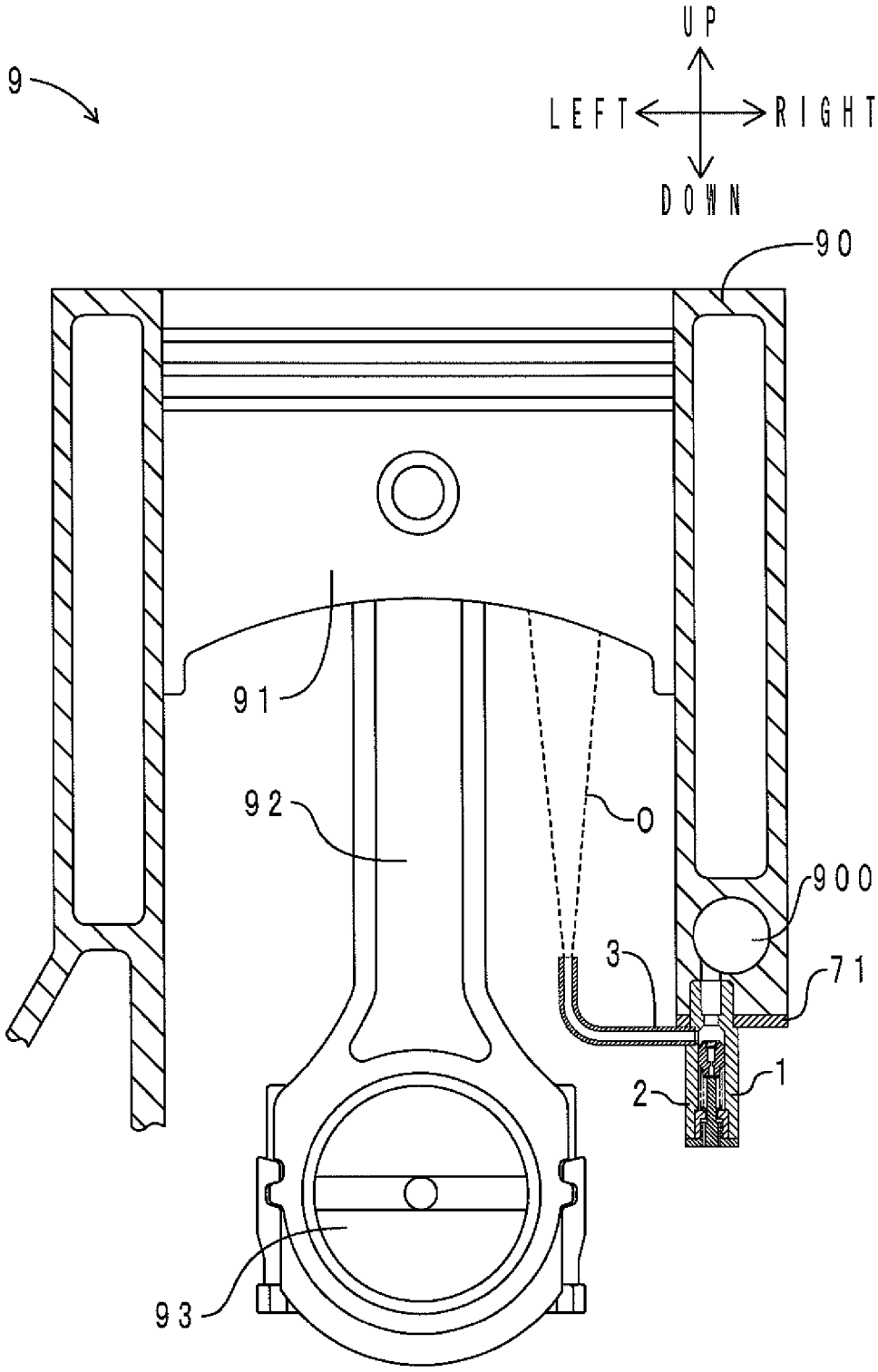
FIG. 1 shows the arrangement of a piston cooling jet according to a first embodiment.

First, the arrangement of the piston cooling jet according to the embodiment will be described. FIG. 1 shows the arrangement of the piston cooling jet according to the embodiment. As shown in FIG. 1, an engine 9 includes a cylinder block 90, a piston 91, a connecting rod 92, and a crankshaft 93.

The piston 91 is connected to the crankshaft 93 via the connecting rod 92. The piston 91 is reciprocally movable in the up-down direction in the cylinder block 90. A main oil gallery 900 is formed in the cylinder block 90. The main oil gallery 900 is included in the concept of the "engine-side oil passage" according to the present invention. A piston cooling jet 1 is attached to the cylinder block 90.

Oil is circulated in the engine 9 through an oil pan (not shown), a pump (not shown), an oil filter (not shown), the cylinder block 90, the piston cooling jet 1, and again the oil pan. That is, in the oil circulation circuit, the cylinder block 90 is disposed downstream of the oil filter and upstream of the piston cooling jet 1.

The piston cooling jet 1 shown in FIG. 1 is in the valve open state. As indicated by the dotted lines in FIG. 1, the piston cooling jet 1 can spray oil O in the main oil gallery 900 toward the lower surface (back surface, that is, a surface on the opposite side from a combustion chamber) of the piston 91.

[Configuration of Piston Cooling Jet]

Figure 2:
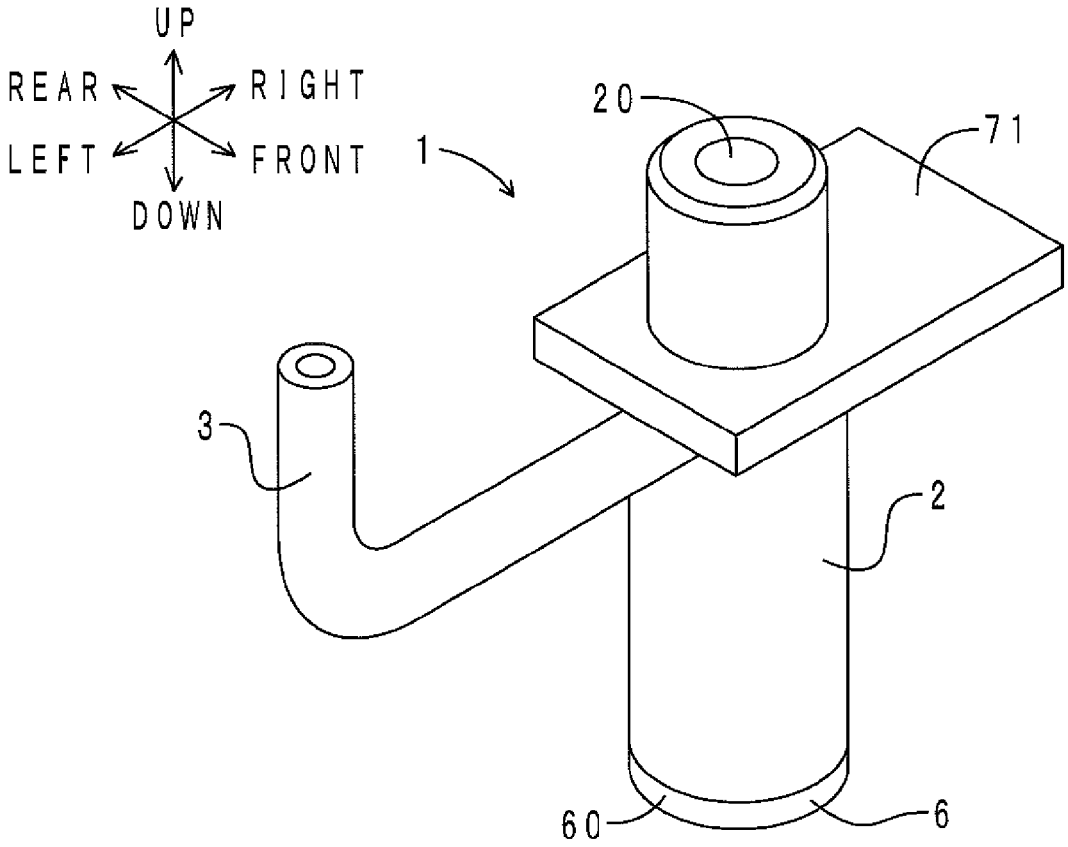
FIG. 2 is a perspective view of the piston cooling jet.
Figure 3:
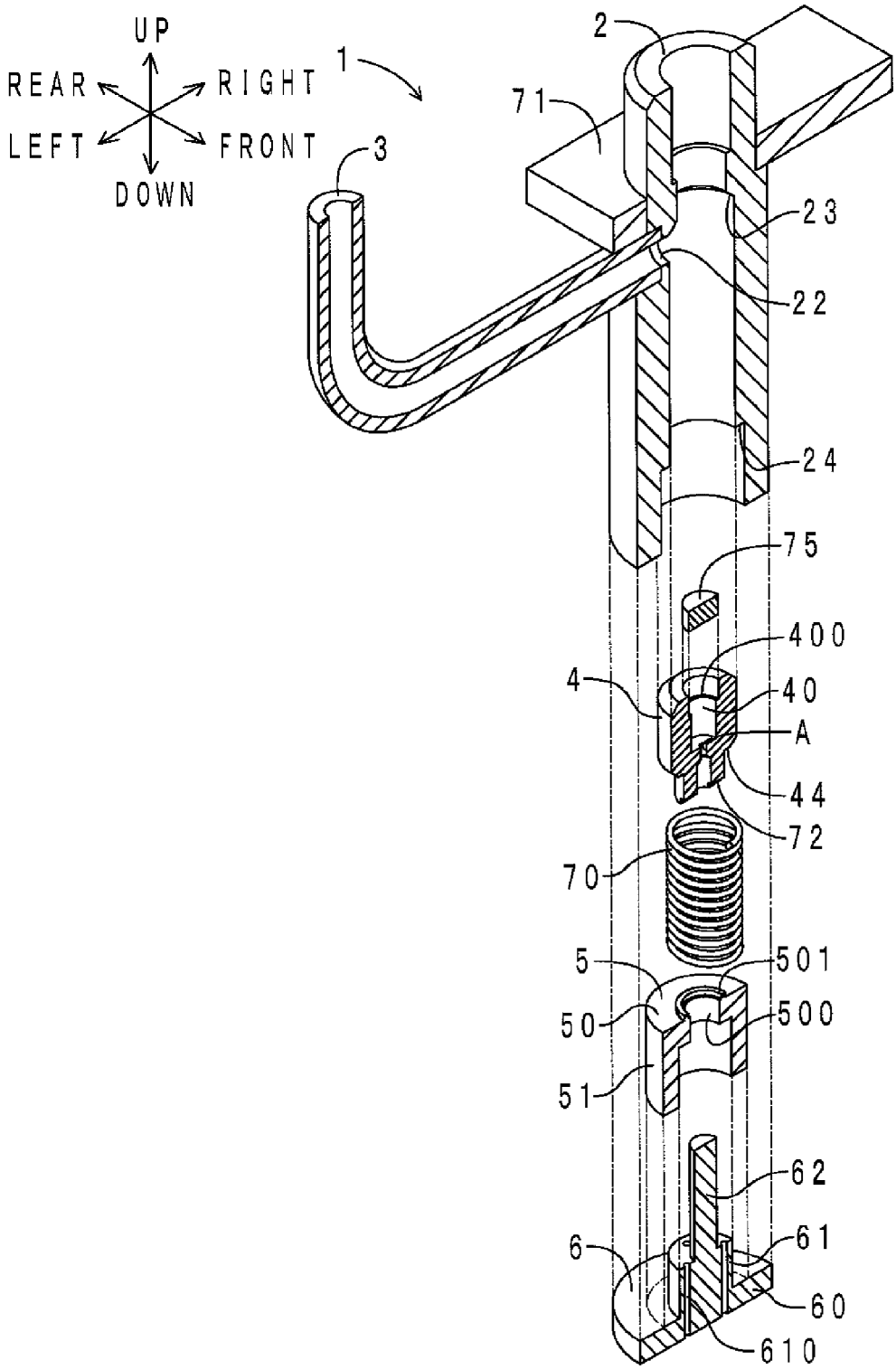
FIG. 3 is an exploded perspective sectional view of the piston cooling jet.
Figure 4:
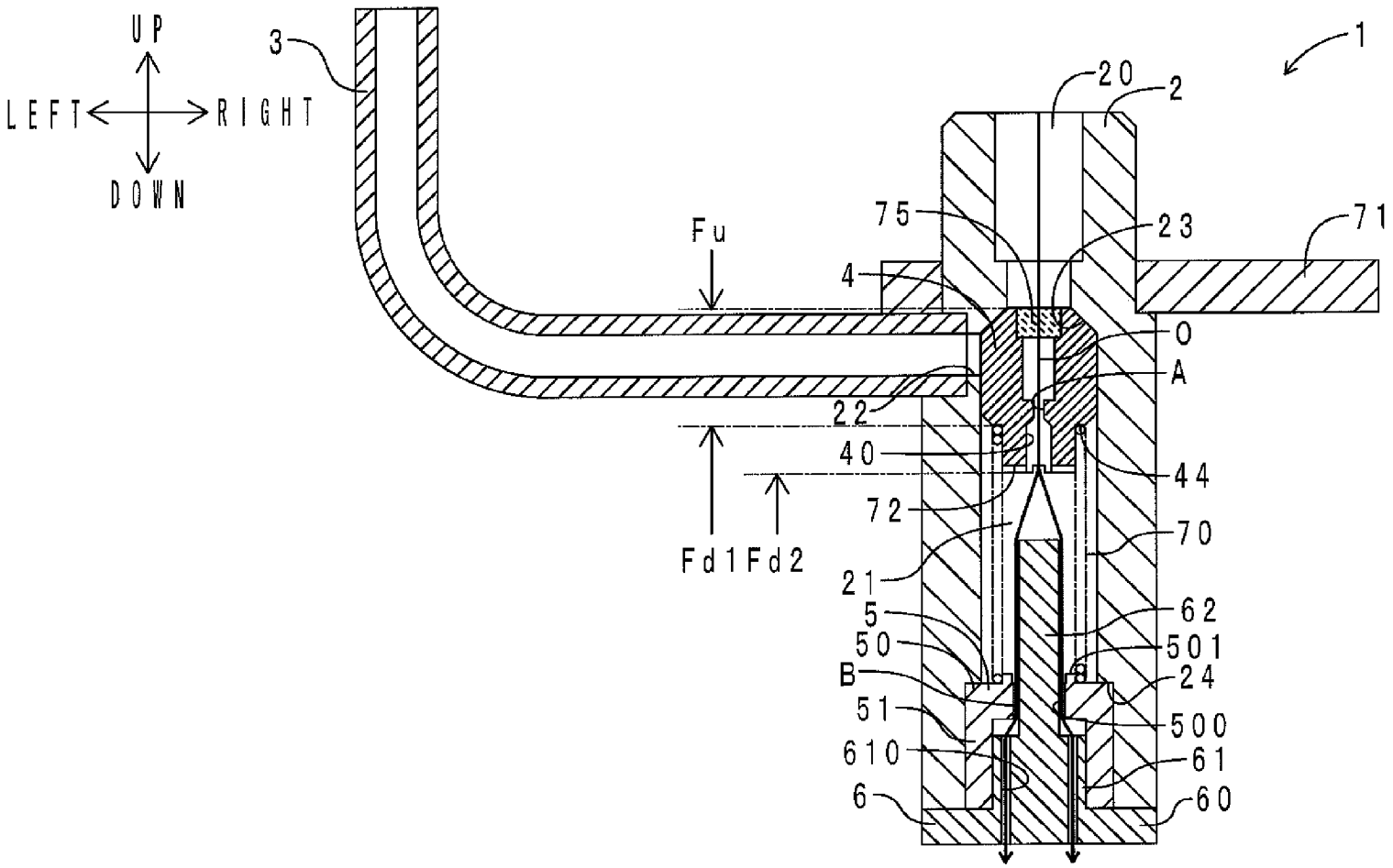
FIG. 4 is a sectional view, in the up-down direction, of the piston cooling jet in the valve closed state.
Figure 5:
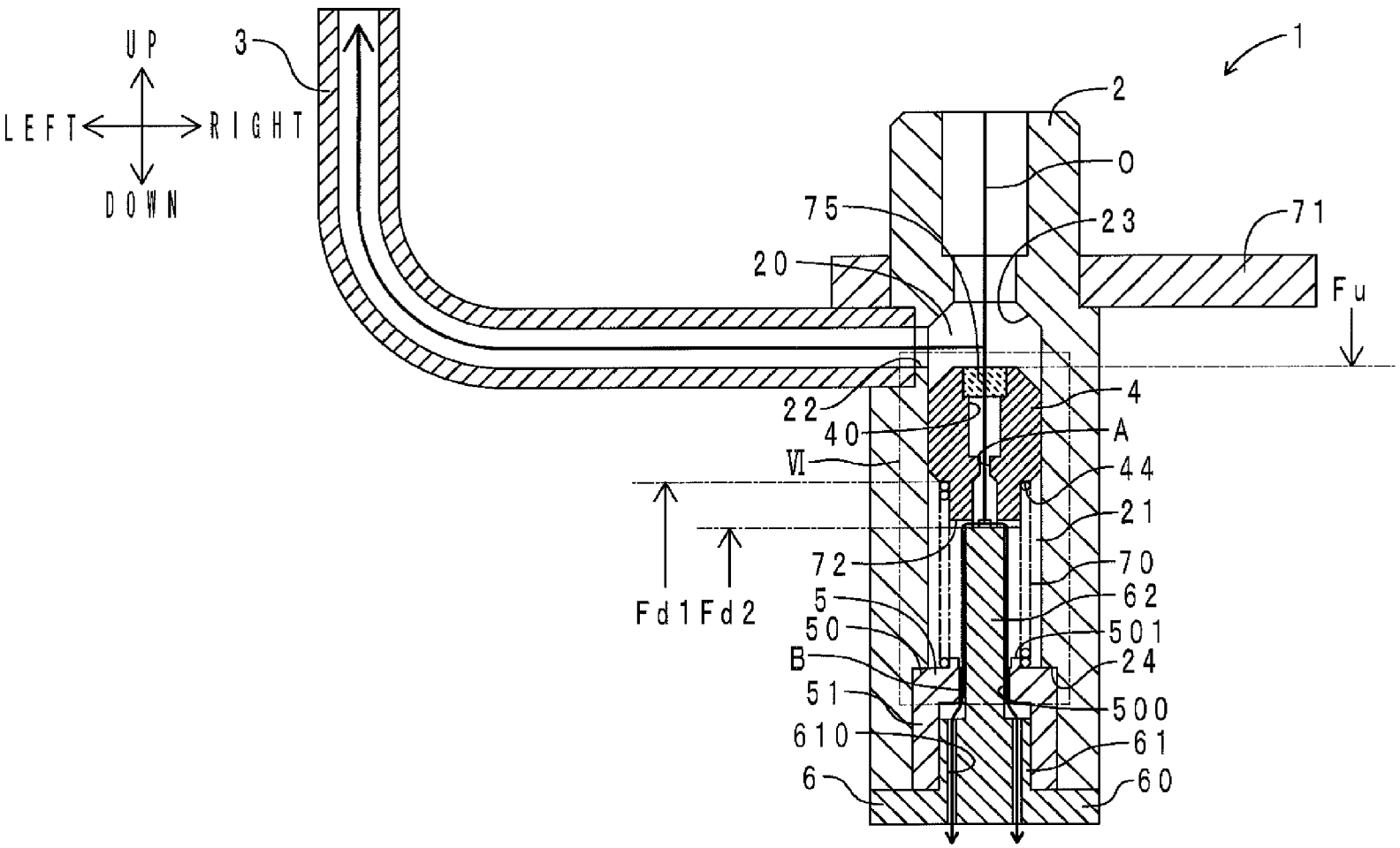
FIG. 5 is a sectional view, in the up-down direction, of the piston cooling jet in the valve open state.
Figure 6:
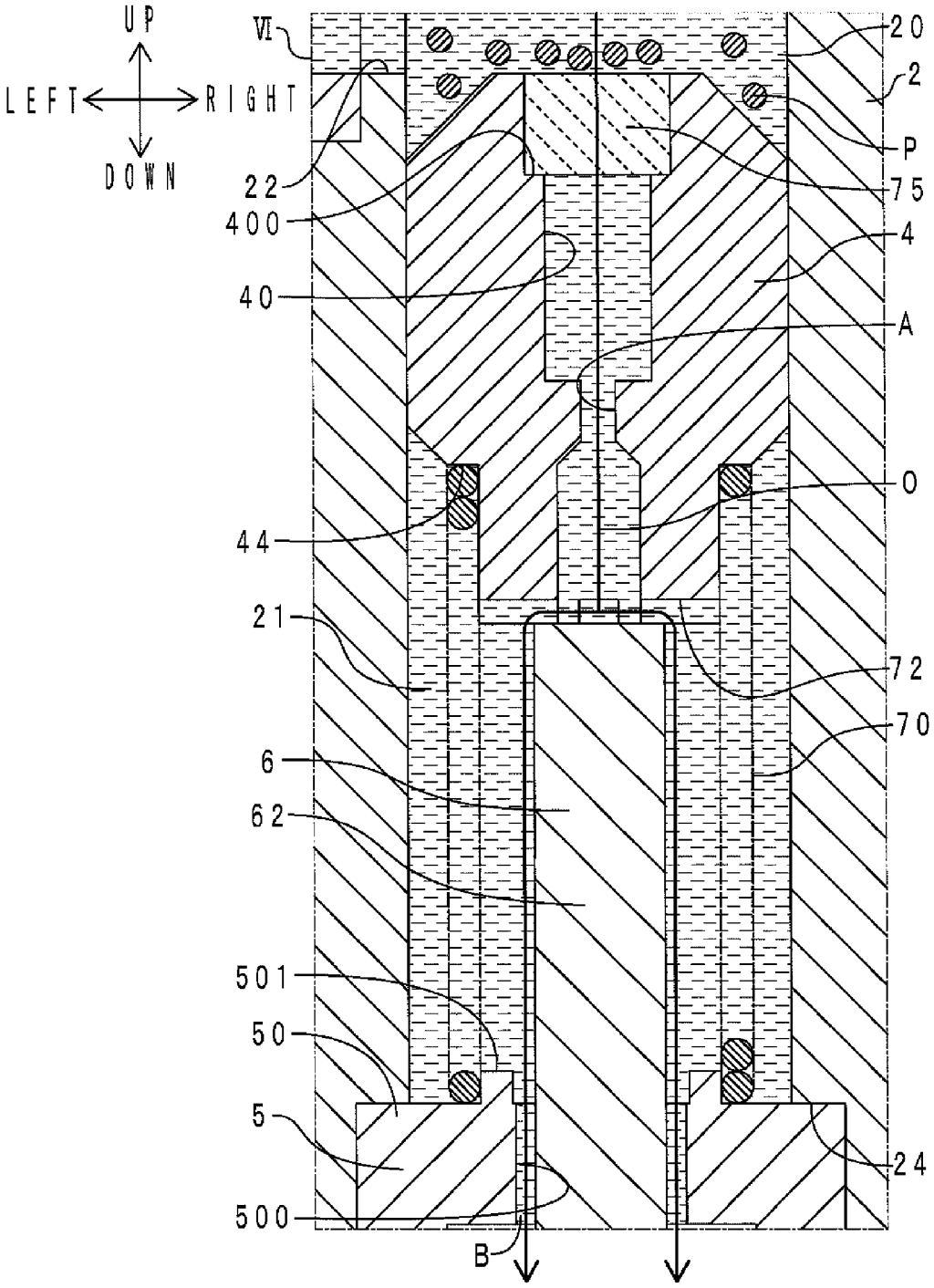
FIG. 6 is an enlarged view of the inside of a box VI in FIG. 5.

Next, the configuration of the piston cooling jet according to the embodiment will be described. In the following drawings, the upper side corresponds to the "front side" according to the present invention. Meanwhile, the lower side corresponds to the "back side" according to the present invention. FIG. 2 is a perspective view of the piston cooling jet according to the embodiment. FIG. 3 is an exploded perspective sectional view of the piston cooling jet. FIG. 4 is a sectional view, in the up-down direction, of the piston cooling jet in the valve closed state. FIG. 5 is a sectional view, in the up-down direction, of the piston cooling jet in the valve open state. FIG. 6 is an enlarged view of the inside of a box VI in FIG. 5.

As shown in FIGS. 1 to 6, the piston cooling jet 1 includes a housing 2, a nozzle 3, a valve 4, a holder 5, a plug 6, a coil spring 70, a bracket 71, a groove 72, and a filter 75.

(Housing 2 and Bracket 71)

The housing 2 is made of steel, and has a cylindrical shape. As shown in FIG. 1, the housing 2 is fixed to the cylinder block 90 via the bracket 71 using bolts (not shown). As shown in FIGS. 4 and 5, the housing 2 includes a pressure receiving chamber 20, a pressure chamber 21, a housing-side nozzle communication hole 22, a first stepped portion 23, and a second stepped portion 24.

The pressure receiving chamber 20 and the pressure chamber 21 are defined inside the housing 2. The pressure receiving chamber 20 and the pressure chamber 21 are partitioned by the valve 4 to be discussed later. That is, the pressure receiving chamber 20 is disposed on the upper side of the valve 4. Meanwhile, the pressure chamber 21 is disposed on the lower side of the valve 4. The respective volumes of the pressure receiving chamber 20 and the pressure chamber 21 are varied in accordance with motion of the valve 4.

The housing-side nozzle communication hole 22 penetrates the side peripheral wall of the housing 2. The cross section of the housing-side nozzle communication hole 22 has a perfect circle shape. The first stepped portion 23 is disposed around the upper end (one end in the axial direction) of the inside of the housing 2. The first stepped portion 23 has a tapered shape in which the diameter is reduced from the lower side toward the upper side. The first stepped portion 23 determines the top dead center (valve closed position) of the valve 4 to be discussed later. The second stepped portion 24 is disposed around the lower end (the other end in the axial direction) of the inside of the housing 2. The second stepped portion 24 has a staircase shape in which the diameter is reduced from the lower side toward the upper side. The second stepped portion 24 determines the attachment position of the holder 5 to be discussed later.

(Nozzle 3, Valve 4, and Filter 75)

As shown in FIGS. 4 and 5, the nozzle 3 is made of steel, and has a long cylindrical shaft shape. The nozzle 3 is provided to project radially outward from the side peripheral wall of the housing 2. As shown in FIG. 1, the upper end (one end in the axial direction) of the nozzle 3 is directed toward the piston 91. The lower end (other end in the axial direction) of the nozzle 3 is connected to the housing-side nozzle communication hole 22 of the housing 2.

As shown in FIG. 6, the valve 4 is made of steel, and has a circular column shape. The valve 4 includes a valve-side oil passage 40 and a valve-side spring seat 44. The valve-side oil passage 40 penetrates the valve 4 in the up-down direction (axial direction). The cross section of the valve-side oil passage 40 has a perfect circle shape. The cross-sectional area of the valve-side oil passage 40 in the left-right direction (direction perpendicular to the axial direction) is reduced compared to the cross-sectional area of the pressure receiving chamber 20 in the left-right direction.

A stepped portion 400 is disposed at the upper portion of the valve-side oil passage 40. The stepped portion 400 has a staircase shape in which the diameter is increased from the lower side toward the upper side.

The filter 75 has a short circular column shape, and includes a mesh made of steel. The filter 75 is disposed in the valve-side oil passage 40. The filter 75 contacts the stepped portion 400 from the upper side. The filter 75 removes foreign matter P from oil O passing through the valve-side oil passage 40. The fineness of the mesh of the filter 75 is set to be smaller than the radial width (opening width) of a leak gap B to be discussed later. Therefore, the foreign matter P that cannot pass through the leak gap B (the foreign matter B that clogs the leak gap B) is filtered out by the filter 75.

An orifice (narrow portion) A is disposed on the lower side (downstream side) of the filter 75 in the valve-side oil passage 40. The cross section of the orifice A has a perfect circle shape. The cross-sectional area of the valve-side oil passage 40 in the left-right direction is locally reduced at the orifice A.

The valve-side spring seat 44 is disposed over the entire periphery on the lower side of the outer peripheral surface of the valve 4. The valve-side spring seat 44 has a staircase shape in which the diameter is increased from the lower side toward the upper side.

(Holder 5 and Coil Spring 70)

As shown in FIGS. 3 to 6, the holder 5 is made of steel, and has the shape of a bottomed cylinder that opens downward. The holder 5 is housed inside the housing 2 so as to contact the second stepped portion 24 of the housing 2. The holder 5 includes a bottom portion 50 and a tubular portion 51.

The bottom portion 50 is disposed on the lower side of the valve 4. The bottom portion 50 has a circular plate shape. The bottom portion 50 includes a holder-side hole 500 and a holder-side spring seat 501. The holder-side hole 500 is disposed at the center of the bottom portion 50 in the radial direction. The holder-side hole 500 penetrates the bottom portion 50 in the up-down direction. The cross section of the holder-side hole 500 has a perfect circle shape. The holder-side spring seat 501 is disposed on the upper surface of the bottom portion 50. The holder-side spring seat 501 is disposed on the radially outer side of the holder-side hole 500. The holder-side spring seat 501 has an annular rib shape. The tubular portion 51 is continuously provided on the lower side of the bottom portion 50. The tubular portion 51 has a cylindrical shape.

The coil spring 70 is made of steel, and interposed between the valve-side spring seat 44 and the holder-side spring seat 501. As shown in FIGS. 4 to 6, the coil spring 70 urges the valve 4 upward (direction of switching the valve 4 from the valve open state to the valve closed state).

(Plug 6)

As shown in FIGS. 3 to 6, the plug 6 is made of steel, and has the shape of a drawing pin that points upward. The plug 6 seals the lower opening of the housing 2. The plug 6 includes a bottom portion 60, a projecting portion 61, and a shaft 62.

The bottom portion 60 has a circular plate shape. The bottom portion 60 covers the lower opening of the housing 2 from the lower side. The projecting portion 61 is provided to project from the upper surface of the bottom portion 60. The projecting portion 61 has a short circular column shape. The projecting portion 61 is housed inside the holder 5. The projecting portion 61 is positioned by the holder 5. The outer peripheral surface of the projecting portion 61 and the inner peripheral surface of the tubular portion 51 contact each other with no gap therebetween. That is, the tubular portion 51 determines the radial position of the projecting portion 61, that is, the shaft 62, with respect to the holder-side hole 500. The projecting portion 61 includes four plug-side oil passages 610. The four plug-side oil passages 610 each extend in the axial direction. The cross section of each of the four plug-side oil passages 610 has a perfect circle shape. The four plug-side oil passages 610 are spaced from each other at intervals of 90°. As shown in FIGS. 4 and 5, the four plug-side oil passages 610 each communicate between the leak gap B to be discussed later and the outside of the housing 2 in the up-down direction (axial direction).

The shaft 62 is provided to project from the upper surface of the projecting portion 61. The shaft 62 has a long circular column shape. The upper surface of the shaft 62 has a planar shape. The cross section of the shaft 62 has a perfect circle shape. The shaft 62 penetrates the radially inner side of the holder-side hole 500. As shown in FIG. 6, in the valve open state, the upper surface of the shaft 62 and the lower surface of the valve 4 contact each other. That is, the upper surface of the shaft 62 determines the bottom dead center (valve open position) of the valve 4.

The shaft 62 and the holder-side hole 500 are disposed coaxially with each other. The leak gap B is defined between the outer peripheral surface of the shaft 62 and the inner peripheral surface of the holder-side hole 500. The leak gap B has an annular shape. The radial width (opening width) of the leak gap B is set to be smaller than the diameter (opening width) of the orifice A. In addition, the cross-sectional area (total opening area) of the leak gap B in the left-right direction (direction perpendicular to the axial direction) is set to be larger than the cross-sectional area (total opening area) of the orifice A in the left-right direction (direction perpendicular to the axial direction).

(Groove 72)

As shown in FIG. 6, the groove 72 is provided to be recessed in the lower surface of the valve 4. As seen from the lower side, the groove 72 extends in the shape of a + (plus) sign. The groove 72 communicates with the valve-side oil passage 40. As shown in FIG. 6, in the valve open state, the lower surface of the valve 4 contacts the upper surface of the shaft 62. An oil passage matching the recessed shape of the groove 72 is defined between the lower surface of the valve 4 and the upper surface of the shaft 62. Therefore, in the valve open state, the valve-side oil passage 40 and the pressure chamber 21 are connected to each other via the groove 72 even though the lower surface of the valve 4 and the upper surface of the shaft 62 contact each other.

[Load Applied to Valve of Piston Cooling Jet]

Next, the load applied to the valve of the piston cooling jet according to the embodiment will be briefly described. As shown in FIGS. 4 and 5, a load Fu due to the hydraulic pressure of the oil O in the main oil gallery 900 is applied to the upper surface of the valve 4 from the upper side. On the other hand, a load Fd1 due to the urging force of the coil spring 70 is applied to the lower surface of the valve 4 from the lower side. In addition, a load Fd2 due to the internal pressure of the pressure chamber 21 (hydraulic pressure of the oil O) is applied to the lower surface of the valve 4 from the lower side.

Thus, the valve 4 received the load Fu applied from the upper side, and the loads Fd1 and Fd2 applied from the lower side. The valve 4 is moved reciprocally in the up-down direction in accordance with the magnitude relationship between these loads. The valve 4 is also subjected to other loads such as the self weight of the valve 4 and buoyancy, depending on the attachment direction of the piston cooling jet 1. For convenience of description, however, such loads are omitted from the discussion here.

[Operation of Piston Cooling Jet]

Next, operation of the piston cooling jet according to the embodiment will be described. As discussed earlier, the valve 4 received the load Fu applied from the upper side, and the loads Fd1 and Fd2 applied from the lower side. The valve 4 is moved reciprocally in the up-down direction in accordance with the magnitude relationship between these loads. That is, the piston cooling jet 1 is switched between the valve closed state shown in FIG. 4 and the valve open state shown in FIG. 5.

The load Fd2 is determined by the internal pressure of the pressure chamber 21. The internal pressure of the pressure chamber 21 is varied in accordance with the relationship between a flow rate Q1 of the oil O flowing into the pressure chamber 21 and a flow rate Q2 of the oil O flowing out of the pressure chamber 21.

That is, the oil O flows into the pressure chamber 21 by way of the orifice A. Therefore, defining the density of the oil O as ρ, the hydraulic pressure in the pressure receiving chamber 20 (that is, in the main oil gallery 900 shown in FIG. 1) as Pa, the hydraulic pressure in the pressure chamber 21 as Pb, the flow rate coefficient as K1, and the cross-sectional area of the flow path through the orifice A as S, the flow rate of the oil O passing through the orifice O, that is, the flow rate Q1 of the oil O flowing into the pressure chamber 21, is derived using Bernoulli's theorem from Formula (1) below:

$$Q1 = K1 \times S \times \sqrt{\frac{2(Pa - Pb)}{\rho}} \qquad \text{Formula (1)}$$

It is found from Formula (1) that the flow rate Q1 of the oil O flowing into the pressure chamber 21 is affected by the density p of the oil O. The density p of the oil O is not significantly varied even if the temperature of the oil O is varied. Therefore, the density p of the oil O is not significantly varied for a period from cold times (after the engine 9 is started and when the engine 9 has not been completely warmed up and the piston 91 is at a low temperature) to hot times (after the engine 9 has been completely warmed up and when the piston 91 is at a high temperature). Thus, the flow rate Q1 of the oil O flowing into the pressure chamber 21 is not significantly varied for a period from cold times to hot times.

Meanwhile, the oil O flows out of the pressure chamber 21 by way of the leak gap B. Therefore, defining the viscosity of the oil O as η, the coefficient as K2, and the atmospheric pressure as Pc, the flow rate of the oil O passing through the leak gap B, that is, the flow rate Q2 of the oil O flowing out of the pressure chamber 21, is derived using the Hagen-Poiseuille law from Formula (2) below:

$$Q2 = K2 \times (Pb - Pc) \times \frac{\pi}{12\eta} \qquad \text{Formula (2)}$$

It is found from Formula (2) that the flow rate Q2 of the oil O flowing out of the pressure chamber 21 is affected by the viscosity η of the oil O. The viscosity η of the oil O is significantly varied if the temperature of the oil O is varied. Therefore, the viscosity η of the oil O is significantly varied for a period from cold times to hot times. Thus, the flow rate Q2 of the oil O flowing out of the pressure chamber 21 is significantly varied for a period from cold times to hot times. Specifically, the viscosity η is reduced as the oil temperature is raised. Therefore, as seen from Formula (2), the flow rate Q2 is increased.

Thus, variations in flow rate Q2 with respect to variations in oil temperature are larger than variations in flow rate Q1 with respect to variations in oil temperature. Therefore, as the oil temperature is higher, a greater amount of the oil O leaks from the leak gap B. Thus, as the oil temperature is higher, the internal pressure of the pressure chamber 21 is lower. Hence, as the oil temperature is higher, the load Fd2 is smaller.

During cold times when the oil temperature is low, the load Fd2 is large. Therefore, a large load Fu is required to switch the piston cooling jet 1 from the valve closed state shown in FIG. 4 to the valve open state shown in FIG. 5. That is, the valve opening pressure is increased.

During hot times when the oil temperature is high, on the other hand, the load Fd2 is small. Therefore, a small load Fu is enough to switch the piston cooling jet 1 from the valve closed state shown in FIG. 4 to the valve open state shown in FIG. 5. That is, the valve opening pressure is reduced.

Thus, with the piston cooling jet 1 according to the embodiment, the valve opening pressure is automatically adjusted in accordance with the oil temperature.

[Function and Effect]

Next, the function and effect of the piston cooling jet according to the embodiment will be described. With the piston cooling jet 1 according to the embodiment, as shown in FIGS. 4 and 5, oil spray control can be executed in accordance with the temperature and the hydraulic pressure of oil using the orifice A, the leak gap B, and the coil spring 70. This simplifies the structure of the piston cooling jet 1. This also reduces the number of components.

In a piston cooling jet according to the related art, which is actuated in accordance with the oil temperature, a spring made of a shape memory alloy is used. That is, a spring, the spring constant of which is varied in accordance with the oil temperature, is used. In this respect, the piston cooling jet 1 according to the embodiment does not require a spring made of a shape memory alloy. This reduces the manufacturing cost of the piston cooling jet 1.

As shown in FIG. 6, the groove 72 is provided to be recessed in the lower surface of the valve 4 of the piston cooling jet 1 according to the embodiment. Therefore, the orifice A and the leak gap B can be reliably communicated with each other in the valve open state. That is, the oil O for adjusting the internal pressure of the pressure chamber 21 can be caused to flow from the main oil gallery 900 to the outside of the housing 2 in the valve open state.

In the piston cooling jet 1 according to the embodiment, as shown in FIG. 5, the lower surface of the valve 4 is seated on the upper surface of the shaft 62 in the valve open state. This restricts the valve open position of the valve 4. This also restricts the maximum compression amount of the coil spring 70. Thus, the coil spring 70 is not easily fatigued.

As shown in FIG. 6, the piston cooling jet 1 according to the embodiment includes the filter 75. The filter 75 is disposed upstream of the orifice A and the leak gap B. In addition, the magnitude relationship that the "fineness of the mesh of the filter 75" is smaller than the "radial width (opening width) of the leak gap B", which is in turn smaller than the "diameter (opening width) of the orifice A" is established. Therefore, the foreign matter P mixed in the oil O flowing through the oil path (a path that leads from the main oil gallery 900 to the outside by way of the pressure chamber 21) can be removed by the filter 75. Thus, the foreign matter P does not easily clog the orifice A or the leak gap B.

The filter 75 is disposed in the valve 4. If foreign matter clogs the filter 75, it is difficult for the oil O to pass through the filter 75 from the front side to the back side. That is, the resistance against passage through the filter 75 is increased.

This increases the load Fu applied to the valve 4 from the upper side. Thus, as shown in FIG. 5, the valve 4 is moved downward to bring the piston cooling jet 1 into the valve open state. Thus, with the piston cooling jet 1 according to the embodiment, the valve open state can be secured even in the case where the foreign matter P clogs the filter 75. Therefore, the piston 91 can be cooled even in the case where foreign matter clogs the filter 75 as shown in FIG. 1.

Immediately after the manufacture of the engine 9, machining powder produced during the manufacture may remain in the cylinder block 90. Therefore, if the engine 9 is driven immediately after the manufacture, the machining powder may flow into the piston cooling jet 1 before passing through the oil filter. Thus, the foreign matter P easily clogs the oil path in the piston cooling jet 1.

In this respect, with the piston cooling jet 1 according to the embodiment, the foreign matter P mixed in the oil O can be removed by the filter 75 even in the case where the engine 9 is driven immediately after the manufacture. Therefore, the foreign matter P does not easily clog the orifice A or the leak gap B.

It is conceivable that if the valve 4 were not provided with the filter 75, the foreign matter P passing through the valve-side oil passage 40 would clog the leak gap B. In this case, the internal pressure of the pressure chamber 21 would be increased. This would increase the load Fd2 applied to the valve 4 from the lower side. Thus, the piston cooling jet 1 would be easily switched to the valve closed state as shown in FIG. 4.

In this respect, with the piston cooling jet 1 according to the embodiment, the filter 75 can remove the foreign matter P that cannot pass through the leak gap B. This makes it difficult for the foreign matter P to clog the leak gap B. Thus, the piston cooling jet 1 is easily switched to the valve open state as shown in FIG. 5.

Second Embodiment

A piston cooling jet according to a second embodiment is different from the piston cooling jet according to the first embodiment in that the filter is disposed downstream of the orifice. Another difference is that a rib is disposed on the inner peripheral surface of the housing in the piston cooling jet according to the second embodiment. Only such differences will be described below.

Figure 7:
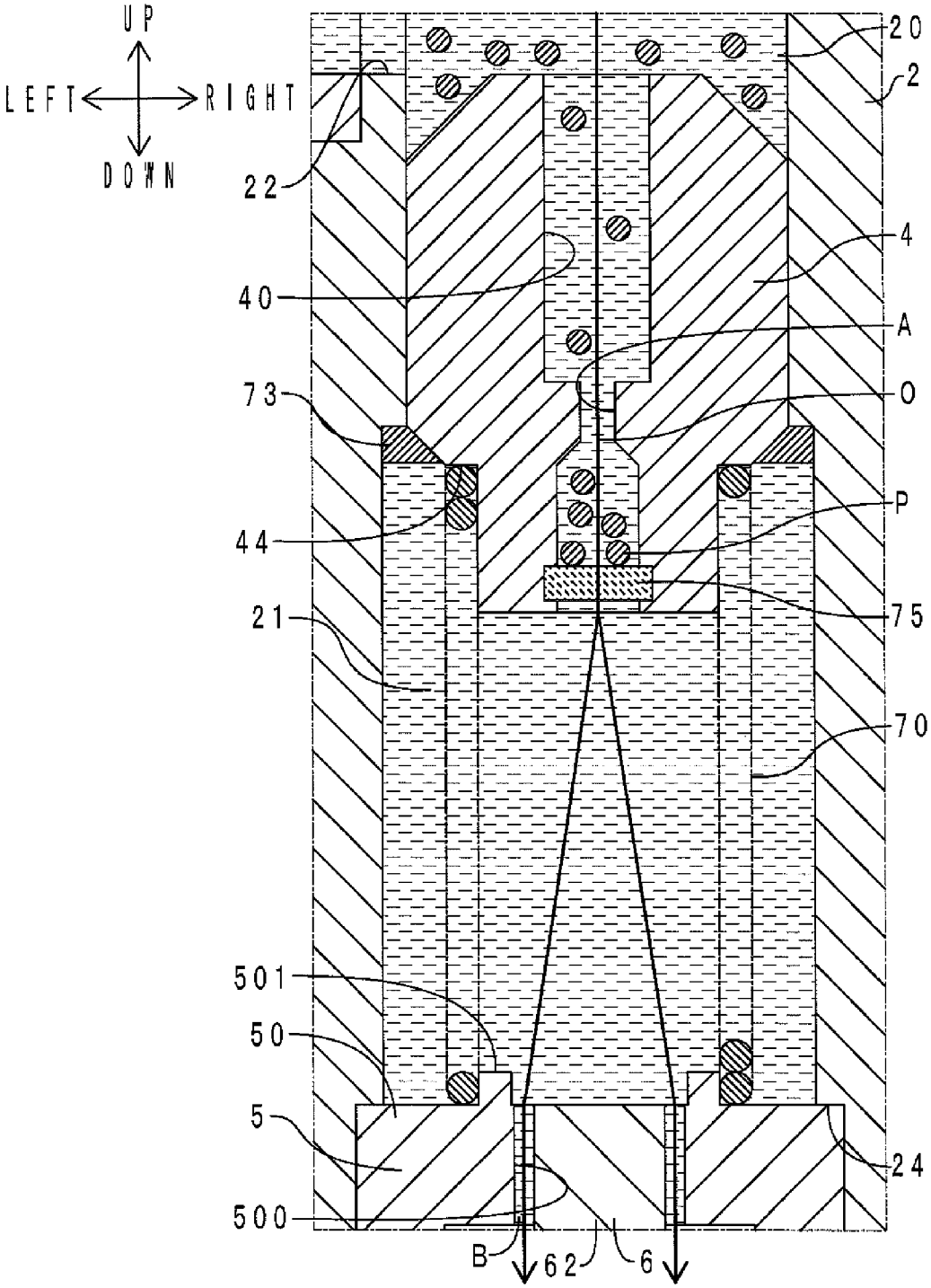
FIG. 7 is an enlarged sectional view, in the up-down direction, of a piston cooling jet according to a second embodiment in the valve closed state.

FIG. 7 is an enlarged sectional view, in the up-down direction, of the piston cooling jet according to the embodiment in the valve closed state. Components corresponding to those of FIG. 6 are denoted by the same reference symbols. As shown in FIG. 7, the filter 75 covers an opening at the lower end of the valve-side oil passage 40. The filter 75 is disposed downstream of the orifice A. The lower surface of the valve 4 has a planar shape. The upper surface of the shaft 62 has a planar shape.

An annular rib 73 is disposed on the inner peripheral surface of the housing 2 (inner peripheral surface of the pressure chamber 21). The rib 73 overhangs radially inward. As seen from the upper side or the lower side, the rib 73 is disposed to overlap the outer peripheral edge of the valve 4. In addition, as seen from the upper side or the lower side, the rib 73 is disposed not to overlap the coil spring 70. The rib 73 determines the bottom dead center (valve open position) of the valve 4. That is, in the valve open state, the rib 73 supports the valve 4 from the lower side. Therefore, a gap is secured between the lower surface of the valve 4 and the leak gap B.

The piston cooling jet according to the embodiment and the piston cooling jet according to the first embodiment have the same function and effect as far as components that are common in configuration are concerned. In the piston cooling jet according to the embodiment, the rib 73 is disposed on the inner peripheral surface of the housing 2. Therefore, in the valve open state, a gap is secured between the lower surface of the valve 4 and the leak gap B. This allows communication between the valve-side oil passage 40 and the pressure chamber 21. Reducing the width of the gap in the up-down direction can reduce the length of the housing 2 in the up-down direction, and hence the length of the piston cooling jet 1 in the up-down direction.

Even if the filter 75 is disposed downstream of the orifice A as in the embodiment, it is possible to suppress clogging of the leak gap B with the foreign matter P. Since the valve 4 is provided with the filter 75, the piston cooling jet can be switched to the valve open state in the case where the foreign matter P clogs the filter 75.

Other Embodiments

The piston cooling jets according to the embodiments of the present invention have been described above. However, the present invention is not specifically limited to the embodiments described above. Various modifications and improvements may also be made by those skilled in the art.

The type of the filter material of the filter 75 shown in FIG. 6 is not specifically limited. For example, the oil O may be filtered using filter paper, synthetic fibers, a metal mesh, or the like. It is only necessary that the foreign matter P that cannot pass through the leak gap B should be removed.

The placement location of the filter 75 is not specifically limited. The filter 75 may be disposed outside the valve-side oil passage 40. For example, the filter 75 may be affixed to the upper surface or the lower surface of the valve 4. The number of filters 75 provided is not specifically limited. For example, a plurality of filters 75 with different mesh fnenesses (filter hole widths) may be arranged in series such that the meshes become sequentially finer from the upstream side toward the downstream side. The filter hole width of the filter 75 is not specifically limited. For example, the filter hole width of the filter 75 may be 50 μm or less.

In the first embodiment, as shown in FIG. 6, the groove 72 is disposed in the lower surface of the valve 4. However, the groove 72 may be disposed in the upper surface of the shaft 62. Alternatively, the groove 72 may be disposed in the lower surface of the valve 4 and the upper surface of the shaft 62. That is, an oil passage may be secured between the lower surface of the valve 4 and the upper surface of the shaft 62 with the grooves 72 facing each other in the up-down direction combined with each other.

The cross-sectional shape of the pressure receiving chamber 20, the pressure chamber 21, the valve-side oil passage 40, the housing-side nozzle communication hole 22, the internal space of the nozzle 3, the orifice A, and the plug-side oil passage 610 shown in FIGS. 4 and 5 in the direction orthogonal to the passage direction is not specifically limited. Example of the cross-sectional shape include a perfect circle shape, an elliptical shape, and a polygonal shape (such as a triangular shape, a quadrangular shape, a pentagonal shape, and a hexagonal shape).

The cross-sectional shape of the leak gap B shown in FIG. 6 in the direction orthogonal to the passage direction is not specifically limited. Examples of the cross sectional shape include a ring shape (such as a perfect circle ring shape, an elliptical ring shape, and a polygonal ring shape), a slit shape, a perfect circle shape, an elliptical shape, and a polygonal shape. The leak gap B may be disposed in the side peripheral wall of the housing 2. This makes it difficult for the foreign matter P to clog the leak gap B.

A plurality of leak gaps B may be disposed. In this case, the term "opening width" according to the present invention refers to the opening width of a single leak gap B. In addition, the term "total opening area" according to the present invention refers to the total sum of the opening areas of all the leak gaps B.

In the case where the opening shape of the orifice A or the leak gap B is an elongated shape (for example, a slit shape, a ring shape, or the like), the term "opening width" according to the present invention refers to the width in the short-length direction of the orifice A or the leak gap B.

In the case where the opening shape of the orifice A or the leak gap B is a perfect circle shape, an elliptical shape, or a polygonal shape, the term "opening width" according to the present invention refers to the length of a line passing through the center of figure of the opening shape of the orifice A or the leak gap B. For example, in the case where the orifice A or the leak gap B has a perfect circle shape, the term "opening width" according to the present invention refers to the diameter.

The shape of the groove 72 as seen from the upper side or the lower side is not specifically limited. The shape of the groove 72 may be a "+" sign shape, a "−" sign shape, or a Y shape. The groove 72 may be disposed radially at intervals of an equal angle such as 30°, 45°, 60°, 90°, 120°, and 180°.

In the second embodiment, as shown in FIG. 7, the rib 73 having an endless ring shape is provided. However, a single or a plurality of protrusions that projects radially inward may be provided in place of the rib 73. In the case where a plurality of protrusions is provided, the protrusions may be disposed on the inner peripheral surface of the housing 2 at intervals of an equal angle.

In the embodiments described above, as shown in FIGS. 4 and 5, the valve-side oil passage 40 is provided with the orifice A. However, the valve-side oil passage 40 may be provided with no orifice A.

In the embodiments described above, as shown in FIGS. 6 and 7, members (the shaft 62 and the rib 73) that determine the bottom dead center of the valve 4 are provided. However, the members that determine the bottom dead center of the valve 4 may not be provided. That is, the bottom dead center of the valve 4 may be restricted by the coil spring 70 and the internal pressure of the pressure chamber 21.

What is claimed is:

1. A piston cooling jet comprising:

a housing;

a nozzle provided to project outward from the housing and capable of spraying oil toward a piston;

a valve capable of moving reciprocally inside the housing and configured to receive a load due to a hydraulic pressure in an engine-side oil passage applied from a front side of the valve, the valve including a valve-side oil passage that communicates with the engine-side oil passage;

a pressure chamber defined inside the housing on a back side of the valve, the pressure chamber communicating with the valve-side oil passage;

a pressure adjusting passage disposed between the pressure chamber and a space outside the housing; and a filter disposed in the valve and configured to remove foreign matter that cannot pass through the pressure adjusting passage from oil passing through the valve-side oil passage, wherein the piston cooling jet is switchable between a valve closed state in which communication between the engine-side oil passage and the nozzle is prohibited, and a valve open state in which communication between the engine-side oil passage and the nozzle is allowed with the valve moved toward the back side to reduce a volume of the pressure chamber compared to that in the valve closed state.

2. The piston cooling jet according to claim 1, wherein:

the valve-side oil passage includes an orifice; and the pressure adjusting passage is a leak gap that is smaller in opening width than the orifice and that is larger in total opening area than the orifice.

3. The piston cooling jet according to claim 2, wherein the filter is disposed upstream of the orifice.

4. The piston cooling jet according to claim 1, wherein the valve and the pressure adjusting passage are arranged such that the engine-side oil passage and the pressure adjusting passage are in fluid communication when the piston cooling jet is in the valve open state.

5. The piston cooling jet according to claim 1, wherein the filter is arranged such that, when the piston cooling jet is in the valve open state, oil flows from the engine-side oil passage to the nozzle while bypassing the filter.

* * * * *